US011638851B2

(12) United States Patent
Hunt et al.

(10) Patent No.: US 11,638,851 B2
(45) **Date of Patent: *May 2, 2023**

(54) NECK EXERCISE DEVICE AND SYSTEM

(71) Applicant: Gonza LLC, Leesburg, VA (US)

(72) Inventors: Thomas Harrison Hunt, Leesburg, VA (US); Zachary Wyatt Elam, San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/973,477

(22) Filed: Oct. 25, 2022

(65) Prior Publication Data

US 2023/0048241 A1 Feb. 16, 2023

Related U.S. Application Data

(63) Continuation of application No. 17/849,505, filed on Jun. 24, 2022, which is a continuation of application No. 17/322,867, filed on May 17, 2021, which is a continuation-in-part of application No. 14/477,827, filed on Sep. 4, 2014, now Pat. No. 11,007,405.

(60) Provisional application No. 61/873,417, filed on Sep. 4, 2013.

(51) Int. Cl.

| | |
|---|---|
| ***A63B 21/00*** | (2006.01) |
| ***A63B 23/025*** | (2006.01) |
| ***A63B 21/055*** | (2006.01) |
| ***A63B 21/04*** | (2006.01) |

(52) U.S. Cl.

CPC ..... *A63B 21/4003* (2015.10); *A63B 21/0442* (2013.01); *A63B 21/0557* (2013.01); *A63B 21/4025* (2015.10); *A63B 23/025* (2013.01); *A63B 2209/10* (2013.01); *A63B 2225/09* (2013.01)

(58) Field of Classification Search

CPC ..... A63B 23/025; A63B 21/0442; A63B 21/0407; A63B 21/0557; A63B 21/40–4003; A63B 21/4025; A63B 2209/10; A63B 2225/09

See application file for complete search history.

(56) References Cited

U.S. PATENT DOCUMENTS

| | | | |
|---|---|---|---|
| 1,517,147 | A | 11/1924 | Burnett |
| 1,543,346 | A | 6/1925 | Titus |
| 2,051,366 | A | 8/1936 | Catron |
| 3,042,404 | A | 7/1962 | Masters |
| 3,820,780 | A | 6/1974 | Atrizadeh |
| 4,645,198 | A | 2/1987 | Levenston |

(Continued)

FOREIGN PATENT DOCUMENTS

| | | |
|---|---|---|
| AU | 2010203291 | 2/2012 |
| CN | 201760035 U | 3/2011 |

(Continued)

OTHER PUBLICATIONS

Headset Kit M357—Medicondz, Website found at: nzcordz.com/?s=headset, Apr. 22, 2015, 3 pgs.

(Continued)

*Primary Examiner* — Andrew S Lo

(74) *Attorney, Agent, or Firm* — Cygnet IP Law, PLLC; Stephen W. Aycock, II

(57) ABSTRACT

A neck exercise device and system are disclosed. An implementation of the device can include a head harness having an adjustable headband and a first cranial strap having each end attached to the headband. The device can further include a plurality of attachment members.

19 Claims, 7 Drawing Sheets

(56) References Cited

U.S. PATENT DOCUMENTS

| | | | |
|---|---|---|---|
| 4,832,333 | A | 5/1989 | Lockett |
| 5,336,139 | A | 8/1994 | Miller |
| 5,505,677 | A | 4/1996 | Hinds |
| 5,509,869 | A | 4/1996 | Miller |
| 5,626,544 | A | 5/1997 | Foresto |
| 6,000,066 | A | 12/1999 | Williams |
| 6,106,437 | A | 8/2000 | Brooks |
| 8,529,269 | B2 | 9/2013 | Coulombe |
| 8,613,690 | B1 | 12/2013 | Thompson |
| 8,840,528 | B2 | 9/2014 | Zylstra |
| 9,216,312 | B2 | 12/2015 | Richardson |
| 9,233,275 | B2 | 1/2016 | Gatherer |
| 2003/0073549 | A1 | 4/2003 | Hatch |
| 2003/0228955 | A1 | 12/2003 | Makoksky |
| 2004/0058780 | A1 | 3/2004 | Edgeton |
| 2005/0043154 | A1 | 2/2005 | Atrizadeh |
| 2006/0178224 | A1 | 8/2006 | DuFour |
| 2007/0004571 | A1 | 1/2007 | Gonzalez |
| 2007/0032355 | A1 | 2/2007 | DiGiacomo |
| 2007/0042869 | A1 | 2/2007 | Pettibon |
| 2008/0119331 | A1 | 5/2008 | Zylstra |
| 2009/0318268 | A1 | 12/2009 | Rosenblum |
| 2012/0165169 | A1 | 6/2012 | Gatherer |
| 2013/0281261 | A1 | 10/2013 | Gatherer |
| 2014/0051557 | A1 | 2/2014 | Befeld |

FOREIGN PATENT DOCUMENTS

| | | | |
|---|---|---|---|
| DE | 10335913 | B3 | 2/2005 |
| FR | 2855762 | B1 | 1/2008 |
| FR | 2917635 | A1 | 12/2008 |
| JP | 4904531 | B2 | 3/2012 |
| WO | 2005016400 | A1 | 2/2005 |

OTHER PUBLICATIONS

U.S. Pat. No. 559,270 issued on Apr. 28, 1896 (Edwards). Please note this patent number was not acceptable in the above format in the U.S. Patents section so thats why it is put into this section for Examiner's consideration.

MediCordz Headset Kit M357, http://www.nzmfg.com/products/sku/M357.aspx (accessed via Internet Archive.org), website page date (according to InternetArchive.org) Jul. 6, 2012, 1 pg.

NECK EXERCISE DEVICE AND SYSTEM

RELATED APPLICATIONS

This application is a continuation of U.S. application Ser. No. 17/849,505, entitled "Neck Exercise Device and System", and filed on Jun. 24, 2022, which is a continuation of U.S. application Ser. No. 17/322,867, entitled "Neck Exercise Device and System", and filed on May 17, 2021, which is a continuation-in-part of U.S. application Ser. No. 14/477,827, entitled "Neck Exercise Device and System", and filed on Sep. 4, 2014, now patented as U.S. Pat. No. 11,007,405, which claims the benefit of U.S. Provisional Application No. 61/873,417, entitled "Neck Exercise Device and System" and filed on Sep. 4, 2013, which are incorporated herein by reference in their entirety.

FIELD

Embodiments relate generally to exercise equipment, and more particularly, to neck exercise devices and systems for neck strengthening, conditioning, toning and/or rehabilitation and methods of making the same.

BACKGROUND

Some conventional neck exercise devices, such as traditional weightlifting head harnesses, may include a chain to attach the harness to one or more weights. The chain may be attached to the head harness at two attachment points. Thus, some conventional neck exercise devices may be cumbersome to use and may offer limited exercise options.

Embodiments were conceived in light of the above-mentioned needs, problems and/or limitations, among other things.

SUMMARY

Some implementations can include a neck exercise device comprising a head harness having an adjustable headband and a first cranial strap having each end attached to the headband. The device can also include a second cranial strap having each end attached to the headband and an adjustable chin strap. The device can further include a plurality of attachment members.

The plurality of attachment members can include a first attachment member disposed adjacent to an area where a first end of the first cranial strap attaches to the headband, and a second attachment member disposed adjacent to an area where a second end of the first cranial strap attaches to the headband. The plurality of attachment members can also include a third attachment member disposed adjacent to an area where a first end of the second cranial strap attaches to the headband, and a fourth attachment member disposed adjacent to an area where a second end of the second cranial strap attaches to the headband.

DETAILED DESCRIPTION

Figure 1:
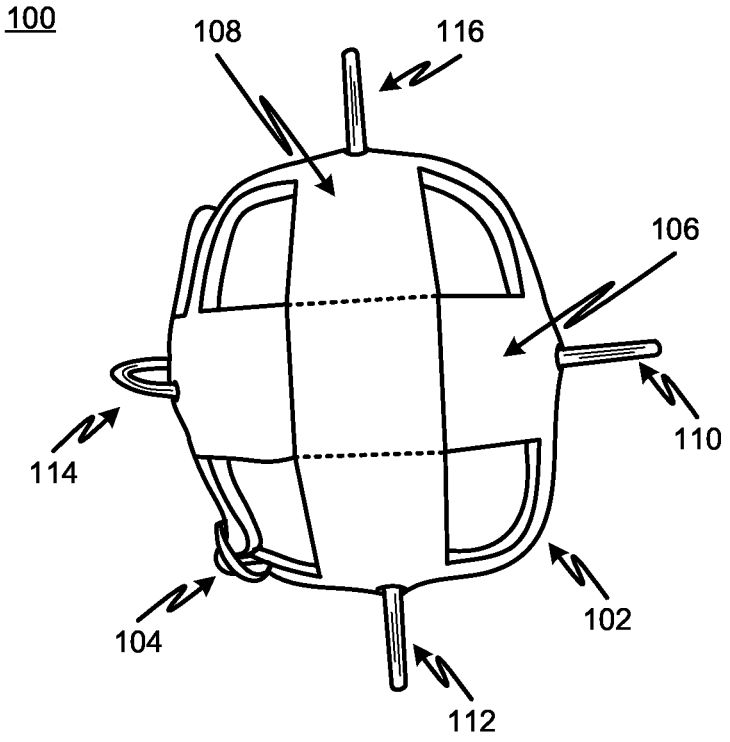
FIG. 1 is a top view diagram of an example neck exercise device in accordance with at least one embodiment.

FIG. 1 shows a top view of an example neck exercise device in accordance with at least one embodiment. In particular, the device 100 includes an adjustable headband 102, a headband adjustment member 104, a first cranial strap 106, a second cranial strap 108, a first attachment member or point 110, a second attachment member or point 112, a third attachment member or point 114, a fourth attachment member or point 116.

The headband 102 and cranial straps 106/108 form a head harness. The headband 102 is configured to extend circumferentially around a user's skull from forehead around the side of the head to the occiput and back around to the forehead. The first cranial strap 106 extends from one side (or temple) region of the skull to the opposite side of the skull and is attached at both ends to the headband 102. The second cranial strap 108 extends from the forehead over the top and crown of the wearer's head to the occipital region and is attached at both ends to the headband. The headband 102 and cranial straps can be formed from 2-inch black heavy polypro webbing or other suitable material. The first cranial strap 106 and second cranial strap 108 can be attached to each other (e.g., stitched together) at a location where the two cross at the crown of the head harness.

The headband 102 includes an adjustment member, which can include a slide (e.g., a 2-inch plastic triglide slide or the like) and 2-inch hook and loop fastener (e.g., Velcro or the like). The attachment members or points can include a 2-inch welded metal D ring (e.g., steel D ring) or other suitable attachment point. Each attachment point 110-116 can be attached to the headband 102 with webbing passing through the attachment point and being secured (e.g., stitched) at each end of the webbing to the headband 102. The attachment points 110-116 (e.g., D rings) can be oriented vertically with respect to the horizontal plane of the headband when being worn, e.g., the D rings can extend from the headband in a similar fashion to the orientation that a human ear extends from the head. It will be appreciated that the D rings could be oriented in other orientations as well. Each attachment member (e.g., D ring) can have an orientation the same as, or different from, the other D rings.

It will be appreciated that although four attachment points are shown in the example embodiment, there could be more or less attachment points in an embodiment.

Figure 2:
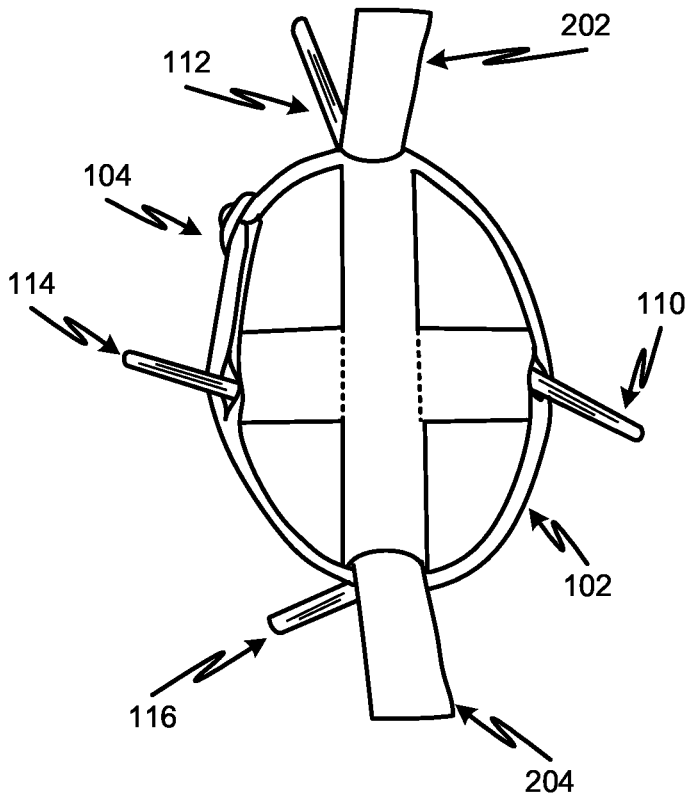
FIG. 2 is a bottom view diagram of an example neck exercise device in accordance with at least one embodiment.

FIG. 2 shows a bottom view of an example neck exercise device in accordance with at least one embodiment. In addition to the elements described above, FIG. 2 shows a chin strap having a first portion 202 and a second portion 204. The chin strap can be formed from 1-inch black heavy polypro webbing or other similar material and attached (e.g., stitched) to the headband 102. The chin strap portions (202 and 204) can each include 1 inch hook and loop fastener to secure the chin strap on a wearer. At least one portion of the chin strap can also include an adjustment member, such as a 1-inch plastic Wide Mouth Heavyduty Triglide Slide (made by YKK), or the like.

In operation, a first chin strap portion can be fed through an adjustment member of the other chin strap portion. The chin strap can be tightened so as to help secure the head harness to a user's head for exercise, and the chin strap can be secured with the hook and loop fastener. One of the chin strap portions can include an adjustable pad configured to slide along the chin strap portion Also, the inside surfaces of the head harness can have padding, such as a 4 mm neoprene with plain backing (or other suitable material) applied (e.g., stitched). The headband and straps can be assembled (e.g., stitched) with heavy duty thread.

Figure 3:
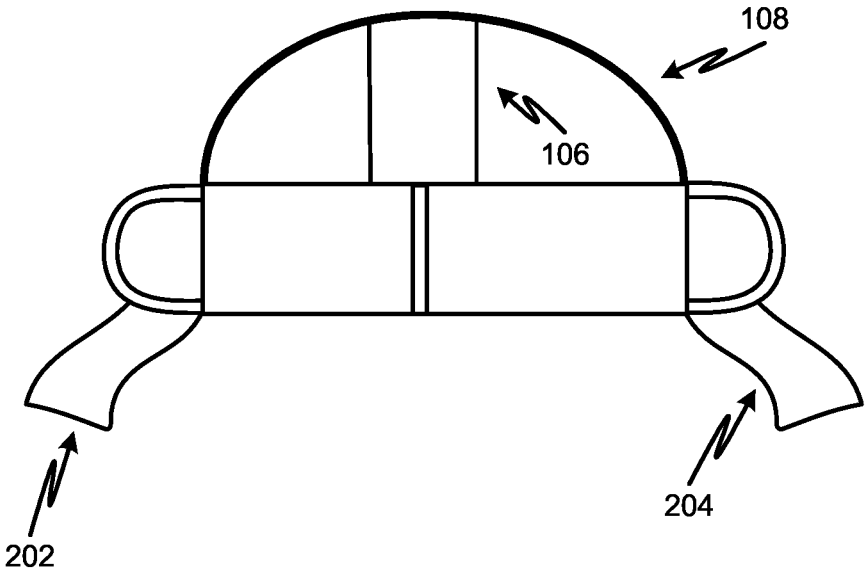
FIG. 3 is a front view diagram of an example neck exercise device in accordance with at least one embodiment.

FIG. 3 shows a front view of an example neck exercise device in accordance with at least one embodiment. In particular, FIG. 3 shows a front view of the neck exercise device with chin straps portions 202/204, and cranial straps 106/108.

Figure 4:
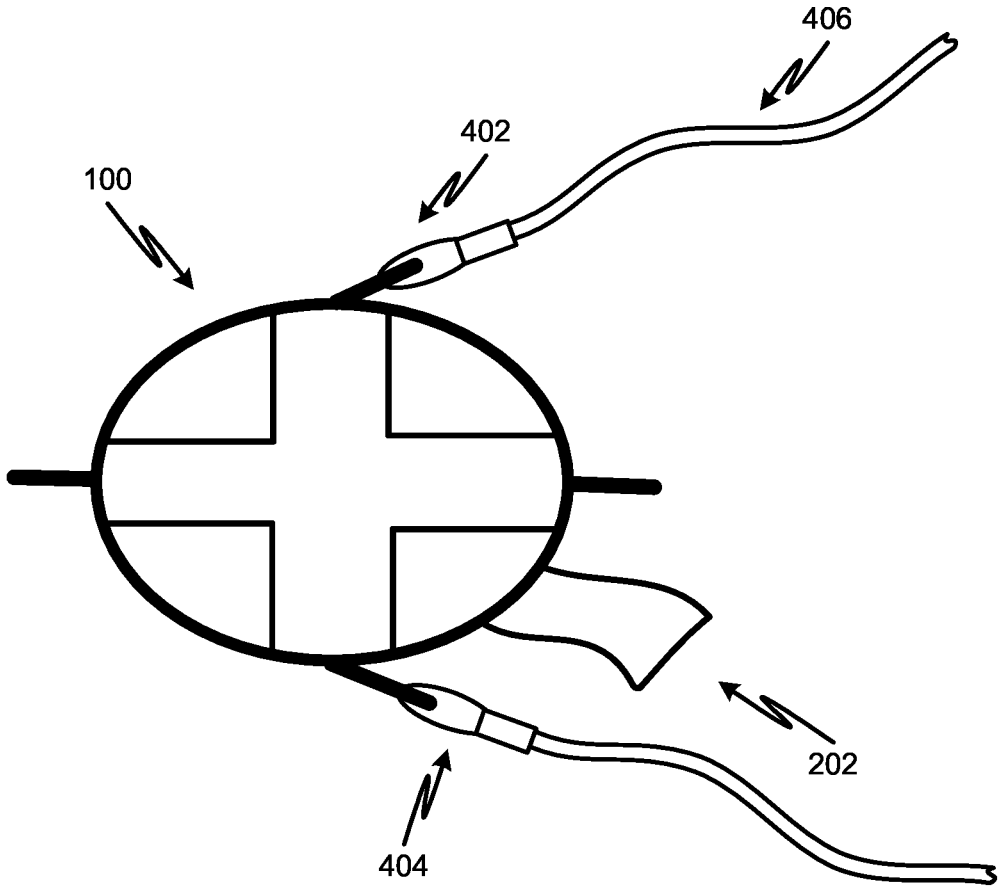
FIG. 4 is a top view diagram of an example neck exercise device in accordance with at least one embodiment.

FIG. 4 shows a top view of an example neck exercise device in accordance with at least one embodiment. In FIG. 4, the head harness 100 is shown with a resistance band 406 (e.g., bungee cord or other suitable elastic material) attached via two carabiners 402/404. The carabiners are configured to attach each end of the resistance band to a respective attachment point (e.g., 110, 114) of the head harness 100. The resistance band 406 can be a single a band with each end having a respective carabiner (402/404) attached.

In operation, one or both ends of the resistance band 406 can be attached to a respective attachment member (e.g., 110-112) and one side or the middle of the resistance band 406 can be temporarily secured (e.g., by hand, foot, wall anchor hook and/or other attachment) and then the head (with the head harness attached) can be moved such that the resistance band 406 generates force against the neck thereby stretching, conditioning and/or strengthening the neck muscles as the head is moved in at least partial opposition to the force of the resistance band 406.

The configuration (e.g., four D rings attached directly to the headband, with one each at the front, rear, left and right sides of the headband respectively) and orientation (e.g., each attachment member being vertically oriented with respect to the horizontal plane of the headband) of the attachment members can provide numerous advantages in terms of the types of resistance that can be provided and, therefore, the types of exercises that can be performed with an embodiment. For example, an exercise can include side to side head (leaning the head toward one of the shoulders) movements with the resistance band ends attached the front attachment member and/or the rear attachment member to provide resistance to the neck. The head movements can include front and back movements (leaning head forward towards the chest and backwards towards the back) with one or both ends of the resistance band attached to the left side attachment member and/or right-side attachment member. The head movements can also include rotational movements with resistance to the neck provided by passing one end of the resistance band through the front attachment member (e.g., D ring) and then through either the right-side attachment member or left side attachment member and finally attaching the end of the resistance band to the rear attachment member. The free end of the resistance band is pulled to the side opposite the side attachment member the band passes through, and the head is rotated in a direction opposite the pulled free end of the resistance band thus applying resistance to the rotation of the neck.

Figure 5:
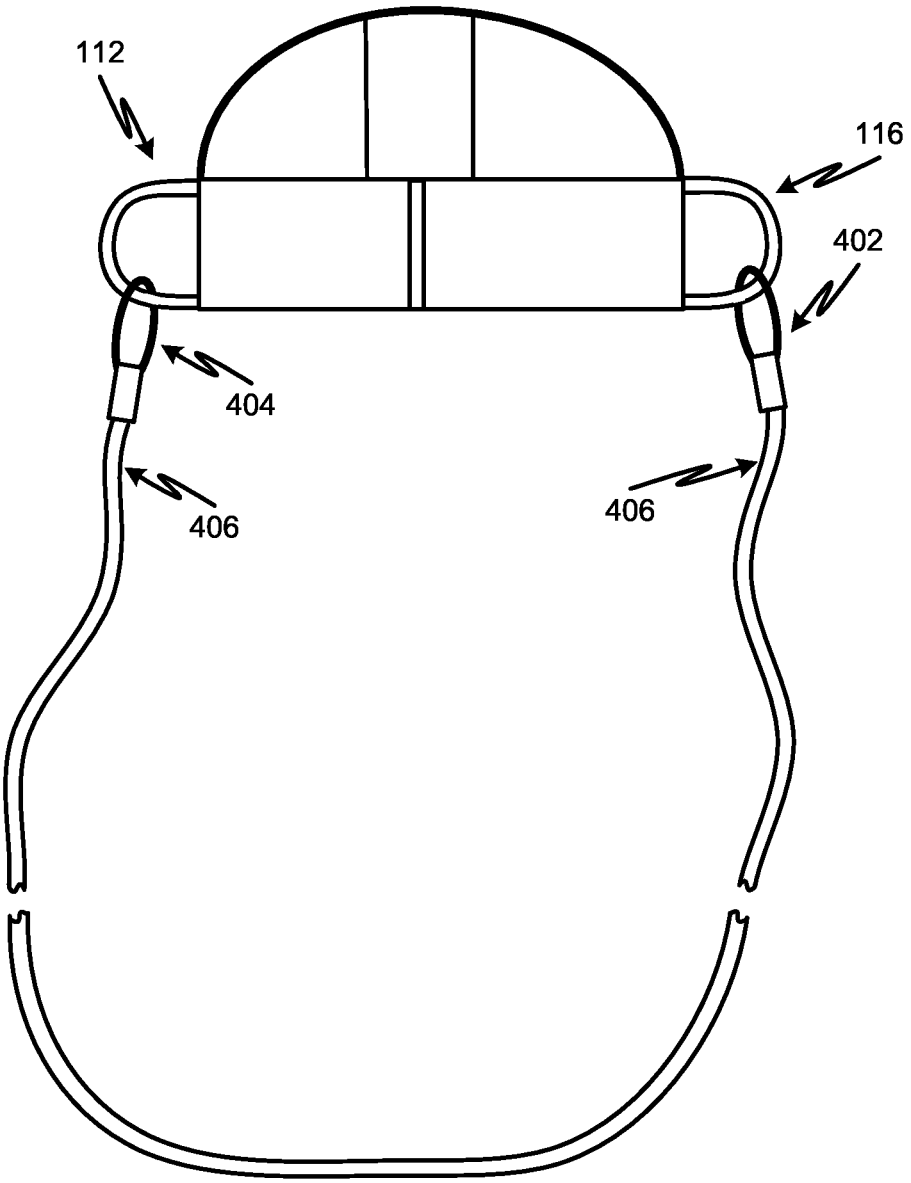
FIG. 5 is a front view diagram of an example neck exercise device in accordance with at least one embodiment.

FIG. 5 shows a front view of an example neck exercise device in accordance with at least one embodiment. FIG. 5 shows the resistance band 406 attached to the head harness via carabiners 402/404 attached to respective attachment points 116/112.

Figure 6:
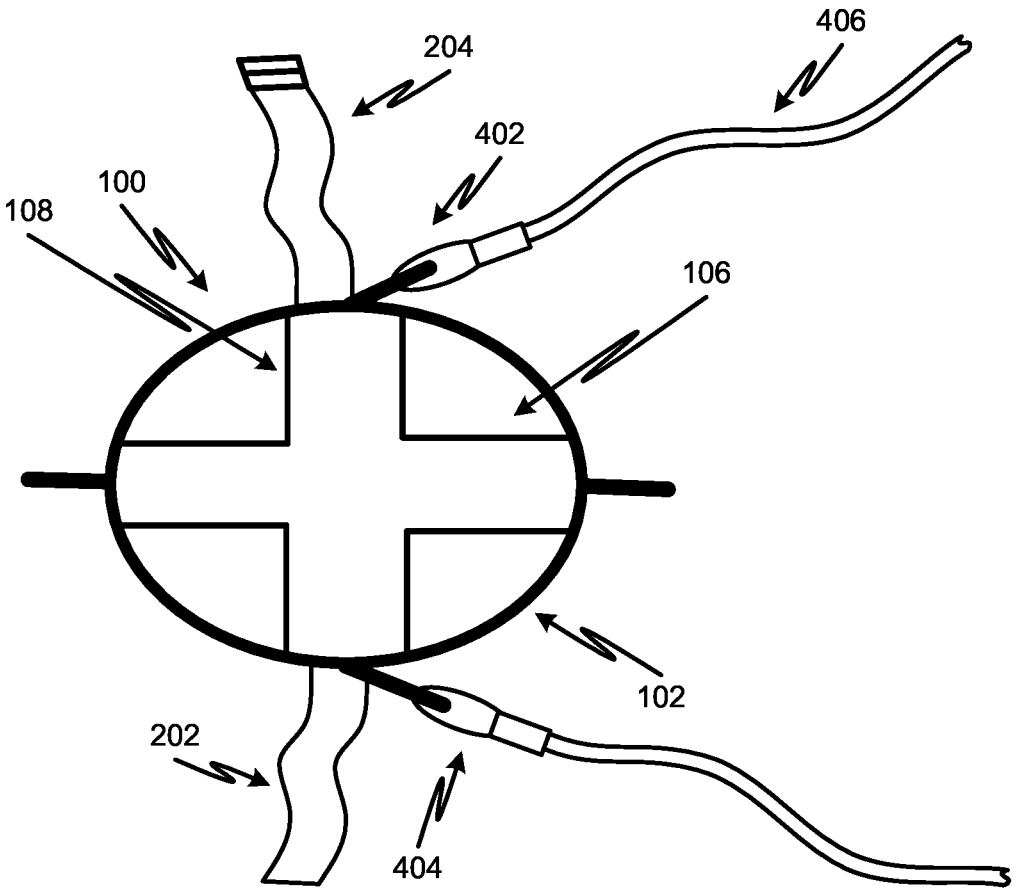
FIG. 6 is a top view diagram of an example neck exercise device in accordance with at least one embodiment.

FIG. 6 shows a top view of an example neck exercise device showing elements described in conjunction with FIGS. 4 and 5.

Figure 7:
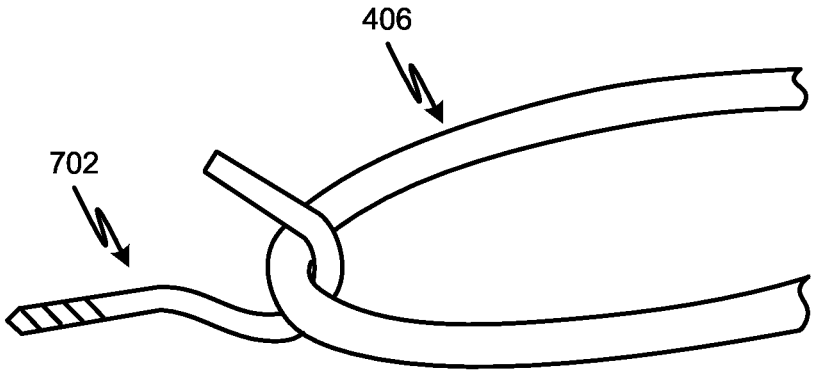
FIG. 7 is a diagram of an example neck exercise device resistance band and wall anchor in accordance with at least one embodiment.

FIG. 7 is a diagram of an example neck exercise device resistance band 406 and wall anchor 702 in accordance with at least one embodiment. The wall anchor can be attached to a wall or other surface to temporarily secure the resistance band 406 for performing one or more neck exercises.

It is, therefore, apparent that there is provided, in accordance with the various embodiments disclosed herein, a neck exercise device and system and method of making the same.

While the disclosed subject matter has been described in conjunction with a number of embodiments, it is evident that many alternatives, modifications and variations would be, or are, apparent to those of ordinary skill in the applicable arts. Accordingly, Applicants intend to embrace all such alternatives, modifications, equivalents and variations that are within the spirit and scope of the disclosed subject matter.

What is claimed is:

1. A neck exercise device comprising:

a head harness having an adjustable headband, wherein the adjustable headband includes a headband adjustment member including at least one of a slide portion and a hook and loop portion, and wherein the adjustable headband has a circumferential length along a first axis and a width along a second axis perpendicular to the first axis;

a first cranial strap having each end attached to the adjustable headband;

a chin strap; and a plurality of metal D-rings attached to the adjustable headband, wherein each metal D-ring of said plurality is attached to the adjustable headband in a vertical orientation parallel to the second axis, wherein each metal D-ring is configured to rotate about the vertical orientation parallel to the second axis, and wherein each metal D-ring is attached to the adjustable headband with webbing stitched to the adjustable headband.

2. The neck exercise device of claim 1, wherein the plurality of metal D-rings includes:

a first metal D-ring disposed adjacent to an area where a first end of the first cranial strap attaches to the adjustable headband; and a second metal D-ring disposed adjacent to an area where a second end of the first cranial strap attaches to the adjustable headband.

3. The neck exercise device of claim 1, wherein each of the plurality of metal D-rings passes through a channel formed at least in part by the adjustable headband.

4. The neck exercise device of claim 1, further comprising a resistance band having a first connector disposed at a first end of the resistance band and a second connector disposed at a second end of the resistance band opposite the first end, wherein the first connector and the second connector are configured to each attach to one of the metal D-rings.

5. The neck exercise device of claim 4, wherein the first connector is a carabiner, and the second connector is a carabiner.

6. The neck exercise device of claim 1, wherein the plurality of metal D-rings includes four metal D-rings, wherein the four metal D-rings are disposed along the circumferential length of the adjustable headband with each of the metal D-rings disposed at a respective position corresponding to a front, a rear, a first side, and a second side of the adjustable headband.

7. A neck exercise device comprising:

a head harness having a headband, wherein the headband has a circumferential length along a first axis and a width along a second axis perpendicular to the first axis; and a plurality of metal D-rings attached to the headband, wherein each metal D-ring is attached to the headband in a vertical orientation parallel to the second axis, wherein each metal D-ring is configured to rotate about the vertical orientation parallel to the second axis, wherein the plurality of metal D-rings includes four metal D-rings, and wherein the four metal D-rings are disposed along the circumferential length of the headband with each of the metal D-rings disposed at a respective position corresponding to a front, a rear, a first side, and a second side of the headband.

8. The neck exercise device of claim 7, wherein the plurality of metal D-rings includes:

a first metal D-ring disposed adjacent to an area where a first end of a first cranial strap attaches to the headband; and a second metal D-ring disposed adjacent to an area where a second end of the first cranial strap attaches to the headband.

9. The neck exercise device of claim 7, wherein each of the plurality of metal D-rings passes through a channel formed at least in part by the headband.

10. The neck exercise device of claim 7, further comprising a resistance band having a first connector disposed at a first end of the resistance band and a second connector disposed at a second end of the resistance band opposite the first end, wherein the first connector and the second connector are configured to each attach to one of the metal D-rings.

11. The neck exercise device of claim 7, further comprising a chin strap.

12. The neck exercise device of claim 7, wherein the headband is adjustable.

13. The neck exercise device of claim 7, further comprising a chin strap.

14. A neck exercise device comprising:

a head harness having a headband, wherein the headband has a circumferential length along a first axis and a width along a second axis perpendicular to the first axis;

a first cranial strap having each end attached to the headband;

a chin strap;

a plurality of rings attached to the headband, each of the plurality of rings being configured to rotate about a vertical orientation parallel to the second axis, wherein the plurality of rings includes four rings disposed along the circumferential length of the headband with each of the rings disposed at a respective position corresponding to a front, a rear, a first side, and a second side of the headband.

15. The neck exercise device of claim 14, wherein the plurality of rings includes:

a first metal D-ring disposed adjacent to an area where a first end of the first cranial strap attaches to the headband; and a second metal D-ring disposed adjacent to an area where a second end of the first cranial strap attaches to the headband.

16. The neck exercise device of claim 14, wherein the plurality of rings comprises a D-ring.

17. The neck exercise device of claim 14, further comprising a resistance band having a first connector disposed at a first end of the resistance band and a second connector disposed at a second end of the resistance band opposite the first end, wherein the first connector and the second connector are configured to each attach to one of the rings.

18. The neck exercise device of claim 17, wherein the first connector is a carabiner, and the second connector is a carabiner.

19. The neck exercise device of claim 14, wherein the headband includes an adjustment member.

* * * * *